US005854960A

United States Patent [19]

Tagansky et al.

[11] Patent Number: 5,854,960

[45] Date of Patent: Dec. 29, 1998

[54] SQUEEGEE ROLLER FOR IMAGING SYSTEMS

[75] Inventors: Boaz Tagansky, Rishon Lezion; Yossi Rosen, Moshav Sytriya, both of Israel

[73] Assignee: Indigo N.V., Maastricht, Netherlands

[21] Appl. No.: 840,664

[22] Filed: Apr. 25, 1997

(Under 37 CFR 1.47)

[30] Foreign Application Priority Data

Oct. 28, 1994 [IL] Israel ..... 111441

[51] Int. Cl.[6] ..... G03G 15/10

[52] U.S. Cl. ..... 399/239; 399/249; 118/262

[58] Field of Search ..... 399/239, 249, 399/348; 118/262, 261; 101/350.1, 363

[56] References Cited

U.S. PATENT DOCUMENTS

| | | | |
|---|---|---|---|
| 3,759,220 | 9/1973 | Saito et al. | 118/261 |
| 3,816,114 | 6/1974 | Fukushima et al. | 430/103 |
| 4,237,592 | 12/1980 | Kuge et al. . | |
| 4,241,694 | 12/1980 | Cormier et al. . | |
| 4,905,047 | 2/1990 | Ariyama . | |
| 5,028,964 | 7/1991 | Landa et al. . | |

FOREIGN PATENT DOCUMENTS

| | | |
|---|---|---|
| 1069578 | 1/1980 | Canada . |
| 2558451 | 12/1975 | Germany . |
| 54-91327 | 7/1979 | Japan . |
| 56-133777 | 10/1981 | Japan . |
| 60-060678 | 4/1985 | Japan . |
| 9301531 | 1/1993 | WIPO . |
| 9416364 | 7/1994 | WIPO . |
| 9613761 | 5/1996 | WIPO . |

OTHER PUBLICATIONS

Patent Abstracts of Japan, vol. 009, No. 195 (P–379), Aug. 13, 1985.

Patent Abstracts of Japan, vol. 006, No. 008 (P–098), Jan 19, 1982.

International Search Reports.

International Preliminary Examination Report.

Written Opinion.

*Primary Examiner*—Joan H. Pendegrass

*Attorney, Agent, or Firm*—Greenblum & Bernstein, P.L.C.

[57] ABSTRACT

Imaging apparatus including squeegee apparatus for squeegeeing excess material from a surface, from which surface at least a portion of the material remaining after squeegeeing is to be transferred to another surface, comprising: a first surface, having a central portion and two end portions having recessed surfaces and having a liquid material thereon at least in said central portion, said surface moving in a given direction at a squeegee region; and a second, squeegee, surface, urged against at least the central portion of the first surface at the squeegee region and formed with contiguous end portions which mate with the recessed end surfaces of the first surface.

58 Claims, 2 Drawing Sheets

SQUEEGEE ROLLER FOR IMAGING SYSTEMS

RELATED APPLICATION

This application is a continuation of pending PCT Application PCT/NL95/00195, filed Jun. 6, 1995 which designated the United States, and claims priority under 35 U.S.C. 119 of Israeli Application No. 111,441, filed Oct. 28, 1994, the disclosures of which are incorporated by reference in their entirety.

BACKGROUND OF THE INVENTION

1. Field of the Invention

The present invention relates to squeegeeing using moving squeegee rollers and more particularly to squeegee rollers for imaging apparatus employing liquid toners.

2. Background and Material Information

In processes for developing images on a photoconductor in imaging machines, especially those employing liquid toner or developer, images or layers of liquid toner are often squeegeed in order to remove excess liquid or excess toner from the image or the layer. This is generally done by urging a squeegee roller (or another moving squeegee surface) together with the surface supporting the image or layer. The squeegee roller surface rides on the image or layer supporting surface and the two surfaces move in the same direction, generally at the same velocity. When the supporting surface is a roller coated with liquid toner concentrate this surface typically contacts or is in close proximity with a photoreceptor, such as a selenium drum or an organic photoconductor, which carries the latent image to be developed. Such systems are disclosed in Patent publications WO 93/01531 and WO 94/16364, the disclosures of which is incorporated herein by reference.

Alternatively, a squeegee is utilized to remove excess carrier liquid from an already developed image on a photoreceptor or other surface. One such use of a squeegee roller is described in U.S. Pat. No. 5,028,964, the disclosure of which is incorporated herein by reference.

In the system described in WO 94/16364, a toner injector injects a quantity of liquid toner onto a rotating developer roller. A (preferably electrified) squeegee roller is urged against the developer roller and compacts and concentrates the liquid toner by removing a portion of the liquid therefrom to form a substantially uniform layer of concentrated liquid toner on the developer roller. During the squeegee operation excess toner and excess carrier liquid removed from the layer are carried toward the ends of the squeegee roller and "run" around the end of the rollers and onto the edge of the developer roller.

A photoreceptor containing a latent image is brought into operational association with the developer roller to develop the latent image by the selective transfer of all or a portion of the concentrated liquid toner layer formed on the developer roller. Excess liquid toner and carrier liquid removed from the toner which is carried along the edge of the roller have a tendency to contaminate the edges of the image developed on the photoreceptor and to form strips of liquid toner on the photoreceptor which are later transferred to a final substrate.

SUMMARY OF THE INVENTION

The present invention seeks to provide a solution to such edge contamination in an imaging machine such as a copier or printer.

In one aspect of the invention a recessed surface such as a beveled surface is provided at the edges of a developer surface, such as the surface of a developer roller or developer belt. The end of the developer surface, which may be contaminated by excess toner, is thus not in contact with the photoreceptor to which the remainder (the central portion) of the developer surface selectively transfers the layer of liquid toner formed on the developer surface. Any excess (untransferred) liquid toner present on the developer surface, including the material at the end of the surface, is removed from the surface after it leaves the photoreceptor surface at a cleaning station which can be of any suitable design.

In a second aspect of the invention, in which a squeegee roller is used to compress and concentrate a liquid toner image already formed on an imaging surface such as a photoreceptor, the photoreceptor is provided with a beveled edge which is not in contact with a final substrate (or an intermediate transfer member) during transfer of the compressed image thereto. The excess liquid or toner at the edges of the photoreceptor is removed therefrom together with any untransferred portions of the image at a cleaning station which can be of any suitable design.

There is thus provided, in accordance with a preferred embodiment of the present invention, imaging apparatus including:

- an imaging surface, having a latent electrostatic image formed thereon, which moves in a given direction at a development region;
- a developer surface, preferably the surface of a developer roller, having a central portion and at least one recessed, preferably beveled, end, the central portion being urged against the imaging surface and moving therewith at a development region; and
- a squeegee surface, preferably the surface of a squeegee roller, urged against at least the central portion of the developer surface at a squeegee region, prior to the development region.

Preferably, the squeegee surface is formed with end portions which mate with the recessed ends of the developer surface.

In a preferred embodiment of the invention, the apparatus further comprises a toner injector which deposits a quantity of liquid toner onto the developer surface prior to the squeegee region. Preferably the apparatus includes a developer surface cleaning station which removes excess toner from the developer surface after it leaves the development region.

There is further provided, in accordance with a preferred embodiment of the invention, imaging apparatus:

an imaging surface, preferably an imaging drum, having a central portion and two recessed, preferably beveled, ends and having a liquid toner image formed on said central portion, which moves in a given direction at a squeegee region;

- a squeegee surface, preferably the surface of a squeegee roller, urged against at least the central portion of the imaging surface at the squeegee region.

Preferably, the squeegee surface is formed with end portions which mate with the recessed ends of the imaging surface.

Preferably the apparatus includes an imaging surface cleaning station which removes excess toner from the imaging surface after it leaves the squeegee region.

There is further provided, in accordance with a preferred embodiment of the invention, squeegee apparatus for squeegeeing excess material from a surface from which surface at least a portion of the material remaining after squeegeeing is to be transferred to a second surface comprising:

a first surface, preferably the surface of a drum, having a central portion and two recessed, preferably beveled, ends and having a liquid material thereon at least in said central portion, which moves in a given direction at a squeegee region; and a squeegee surface, preferably the surface of squeegee roller, urged against at least the central portion of the imaging surface at the squeegee region.

Preferably, the squeegee surface is formed with end portions which mate with the recessed ends of the first surface.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
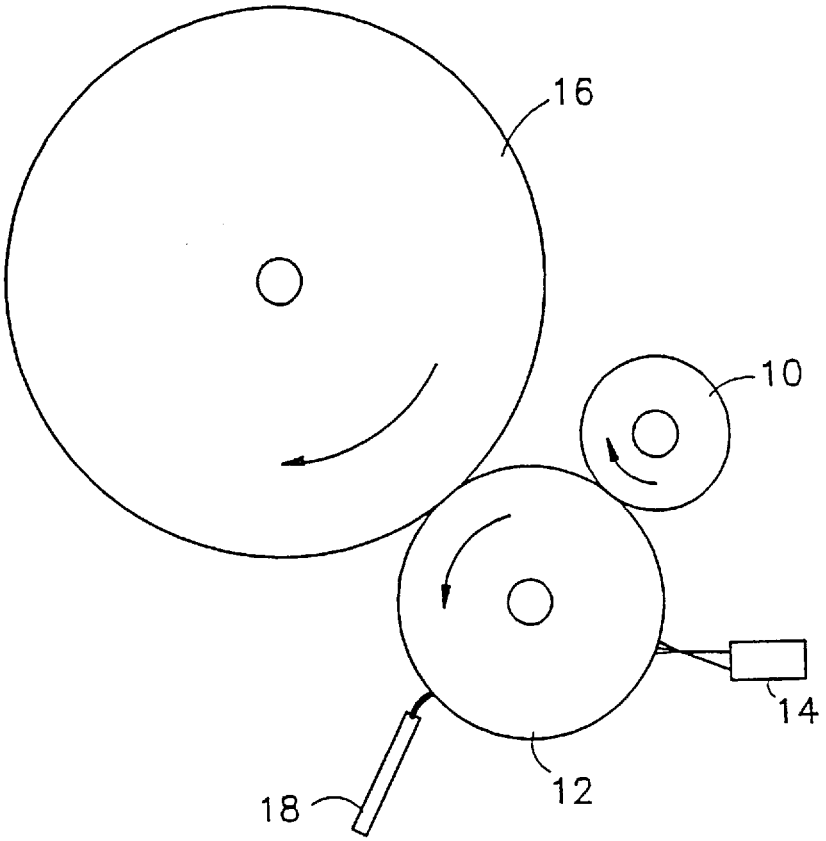
FIG. 1 is a generalized illustration of a portion of imaging apparatus constructed and operative in accordance with a preferred embodiment of the present invention.

Reference is made to FIG. 1 which is a generalized illustration of a portion of an imaging machine constructed and operative in accordance with a preferred embodiment of the present invention. Only those portions of the imaging apparatus necessary to illustrate the invention are included in FIG. 1, the other parts of the apparatus being entirely conventional and very well known in the art.

A liquid toner injector 14 injects liquid toner or liquid toner concentrate onto a counter-clockwise rotating developer roller 12. A clockwise rotating squeegee roller 10 is urged against the developer roller 12 at a squeegee region 50.

In a preferred embodiment of the invention, squeegee roller 10 is electrified to compress the liquid toner layer, spread by toner injector 14, and to remove excess toner by the squeegee action. Squeegee roller 10 thus concentrates the liquid toner and forms a layer thereof on the developer roller as it leaves the squeegee region. Alternatively, any of the apparatus shown in the aforementioned publications WO 93/16364 or WO 93/01531 may be used to form the layer of liquid toner concentrate on developer roller 12.

Developer roller 12 is brought into operational juxtaposition with a photoreceptor drum 16 which has a latent image formed thereon at a development region 52, the latent image having image areas at a first potential and background areas at a second potential. Developer roller 12 is electrified to a potential between the first and second potentials such that at least a portion of the liquid toner layer thereon is selectively transferred from the developer roller to the image areas of the photoreceptor. Such development is described in the aforementioned WO 93/16364 or WO 93/01531.

A cleaning station 18, downstream of development region 52, removes toner and carrier liquid which is not transferred to the photoreceptor. While cleaning station 18 is shown as comprising only a squeegee blade, it may consist of any of the many cleaning stations known in the art and may include a roller or rollers, a brush or brushes and/or a supply of carrier liquid.

Figure 2:
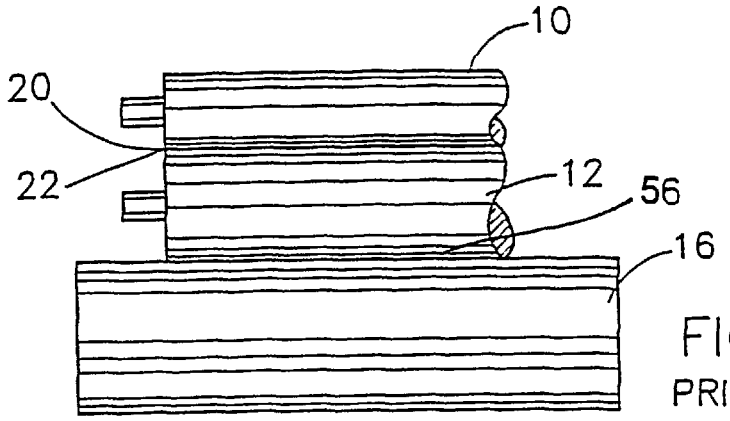
FIG. 2 PRIOR ART
FIG. 2 is a generalized illustration of a portion of the apparatus of FIG. 2 characteristic of the prior art.

Reference is now made to FIG. 2, which shows a combination of squeegee roller 10 having edges 20, developer roller 12 having edges 22 and photoreceptor 16 as known in the prior art.

As described above, squeegee roller 10 is urged against developer roller 12 to form a layer of concentrated liquid toner comprising charged toner particles and carrier liquid, on developer roller 12; liquid toner or liquid toner concentrate having been supplied to either or both rollers prior to their coming into contact or at the point of contact. Developer roller 12 is brought into operational juxtaposition with photoreceptor drum 16 which has a latent image formed thereon, the latent image having image areas at a first potential and background areas at a second potential. Developer roller 12 is electrified to a potential between the first and second potentials such that at least a portion of the liquid toner layer thereon is selectively transferred from the developer roller to the image areas of the photoreceptor.

During the squeegee action on the layer of liquid toner, excess liquid toner and carrier liquid migrate to the edges 20 and 22 of squeegee roller 10 and developer roller 12 respectively. As squeegee roller 10 and developer roller 12 rotate, the excess toner collected at edge 22 is transferred to the surface of photoreceptor 16 and contaminates it.

Figure 3:
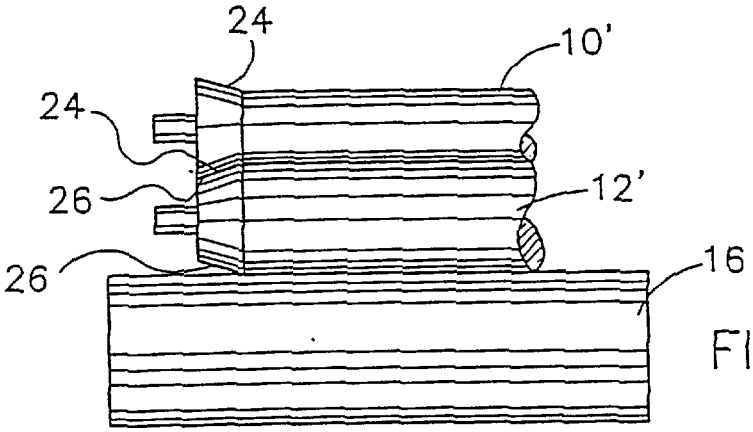
FIG. 3 is a generalized illustration of a portion of the apparatus of FIG. 1 constructed and operative in accordance with a preferred embodiment of the present invention.

Reference is now made to FIG. 3, which is a generalized illustration of a portion of an imaging machine constructed and operative in accordance with a preferred embodiment of the present invention. FIG. 3 shows a squeegee roller 10', a developer roller 12' and a photoreceptor drum 16, all of which rotate together. The general functions of these elements are the same as those of the corresponding elements in the prior art device shown in FIG. 2, however the developer roller and, preferably, the squeegee roller are shaped so as to avoid the problems of the prior art systems as described above.

In the embodiment of FIG. 3, developer roller 12' has beveled ends 26. Preferably, squeegee roller 10' is formed with ends 24 which conform to edges 26 such that the entire surface of the developer and squeegee rollers are in contact and the entire surface of the developer roller is squeegeed by the squeegee roller. As shown in FIG. 3, ends 24 and 26 are cone shaped such that end 24 of squeegee roller 10' forms a diverging cone whereas the beveled end 26 of developer roller 12' forms a converging cone.

As in the prior art, excess liquid toner and carrier liquid, which is squeegeed from the layer of liquid toner formed on the developer roller, migrate to the ends of the rollers. However, unlike the ends of developer roller 12 shown in FIG. 2, the ends of developer roller 12' are not in contact with the surface of photoreceptor 16 and liquid is thus not transferred to the photoreceptor from the ends of the developer roller, the amount of beveling being sufficient to avoid contact of the liquid on the ends 26 with photoreceptor 16.

It is to be appreciated that different cone angles may be employed as long as the cone angle and length of the bevel is sufficient to avoid contact of the liquid on the end of the developer roller with the photoreceptor surface.

Generally speaking, for proper squeegee action one or both of rollers 10' and 12' should be of a resilient material such as an elastomer, or have a resilient coating.

The present invention, while illustrated for a particular preferred embodiment, is also suitable for any squeegeeing situation in which the squeegeed material on a first surface is to be transferred to a further surface and the transfer of excess material at the edges of the first surface is to be avoided.

Figure 4:
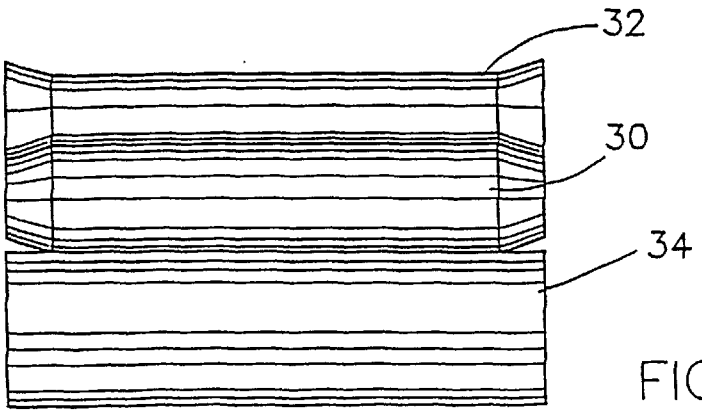
FIG. 4 is a simplified schematic illustration of another embodiment of the invention.

One such situation is illustrated in FIG. 4, in which an imaging surface 30, for example a photoreceptor roller, has a developed image comprising charged toner particles and carrier liquid formed thereon. Imaging surface 30 is formed with beveled ends. A squeegee surface such as a squeegee roller 32, preferably having ends which match the bevel on the imaging surface, is urged against the imaging surface and is preferably electrified to compress and concentrate the image and to remove carrier liquid therefrom. The amount of carrier liquid which may be on the non-image portions of the imaging surface is also reduced by the action of the squeegee. Such squeegee action on images is described in the aforementioned U.S. Pat. No. 5,028,964.

The thus-removed carrier liquid migrates to the edge of rollers 30 and 32. When the photoreceptor comes in contact with a further surface 34, such as a final substrate or an intermediate transfer member, to which the image is to be transferred, this liquid, which may contain some toner particles, may be transferred to the surface 34.

In this embodiment of the invention, the ends of imaging surface 30 are beveled such that liquid at said ends is not transferred to further surface 34. Preferably, the ends of squeegee roller 32 are formed to mate with the beveled edges of imaging surface 30.

While the invention has been shown using the preferred beveled cone shaped ends, other end shapes, such as undercuts (i.e., a smaller diameter at the ends) on the developer roller 12' of FIG. 3 or the imaging surface 30 of FIG. 4 can be used.

It will be appreciated by persons skilled in the art that the present invention is not limited by what has been particularly shown and described hereinabove. Rather the scope of the present invention is defined only by the claims which follow:

We claim:

1. Imaging apparatus including squeegee apparatus for squeegeeing excess liquid from a surface, comprising:

a first surface, having a central portion and two end portions having recessed surfaces and having material thereon at least in said central portion, said surface moving in a given direction at a squeegee region, said material comprising at least a liquid; and a second, squeegee, surface, urged against at least the central portion of the first surface at the squeegee region, such that the squeegee surface removes at least a portion of the liquid on the first surface, said squeegee surface being formed with contiguous end portions which mate with the recessed end surfaces of the first surface, wherein at least a portion of the material remaining on the first surface after removal of a portion of the liquid by the squeegee surface is transferred from the first surface to another surface.

2. Apparatus according to claim 1 wherein the first surface is an imaging surface having a liquid toner image formed thereon.

3. Apparatus according to claim 2 wherein the first surface is the surface of a roller.

4. Apparatus according to claim 3 wherein the squeegee surface is the surface of a squeegee roller, wherein the squeegee surface moves together with the first surface at the squeegee region.

5. Apparatus according to claim 4 wherein the recessed end portions comprise beveled, cone shaped surfaces.

6. Apparatus according to claim 3 wherein the recessed end portions comprise beveled, cone shaped surfaces.

7. Apparatus according to claim 2 wherein the squeegee surface is the surface of a squeegee roller, wherein the squeegee surface moves together with the first surface at the squeegee region.

8. Apparatus according to claim 7 wherein the recessed end portions comprise beveled, cone shaped surfaces.

9. Apparatus according to claim 2 wherein the recessed end portions comprise beveled, cone shaped surfaces.

10. Apparatus according to claim 1 wherein the first surface is the surface of a roller.

11. Apparatus according to claim 10 wherein the squeegee surface is the surface of a squeegee roller, wherein the squeegee surface moves together with the first surface at the squeegee region.

12. Apparatus according to claim 11 wherein the recessed end portions comprise beveled, cone shaped surfaces.

13. Apparatus according to claim 10 wherein the recessed end portions comprise beveled, cone shaped surfaces.

14. Apparatus according to claim 1 wherein the squeegee surface is the surface of a squeegee roller, wherein the squeegee surface moves together with the first surface at the squeegee region.

15. Apparatus according to claim 14 wherein the recessed end portions comprise beveled, cone shaped surfaces.

16. Apparatus according to claim 1 wherein the recessed end portions comprise beveled, cone shaped surfaces.

17. Imaging apparatus comprising:

an imaging surface, having a latent electrostatic image formed thereon, which moves in a first direction at a development region;

a first, developer, surface, having a central portion and two end portions having recessed surfaces, said central portion being urged against the imaging surface and moving therewith in the first direction at a development region and moving in a given direction at a squeegee region prior to the developer surface entering the development region; and a second, squeegee, surface, urged against at least the central portion of the developer surface at the squeegee region.

18. Apparatus according to claim 17 and including means for depositing a quantity of liquid toner onto the developer surface or the squeegee surface prior to their entering the squeegee region.

19. Apparatus according to claim 18 and comprising a developer surface cleaner which removes excess toner from the developer surface after it leaves the development region.

20. Apparatus according to claim 19 wherein the recessed end portions comprise beveled, cone shaped surfaces.

21. Apparatus according to claims 18, wherein the squeegee surface is formed with end portions which mate with the recessed end surfaces of the first surface.

22. Apparatus according to claim 21 wherein the first surface is the surface of a roller.

23. Apparatus according to claim 22 wherein the squeegee surface is the surface of a squeegee roller, wherein the squeegee surface moves together with the first surface at the squeegee region.

24. Apparatus according to claim 23 wherein the recessed end portions comprise beveled, cone shaped surfaces.

25. Apparatus according to claim 22 wherein the recessed end portions comprise beveled, cone shaped surfaces.

26. Apparatus according to claim 21 wherein the squeegee surface is the surface of a squeegee roller, wherein the squeegee surface moves together with the first surface at the squeegee region.

27. Apparatus according to claim 26 wherein the recessed end portions comprise beveled, cone shaped surfaces.

28. Apparatus according to claim 21 wherein the recessed end portions comprise beveled, cone shaped surfaces.

29. Apparatus according to claim 18 wherein the recessed end portions comprise beveled, cone shaped surfaces.

30. Apparatus according to claim 17 and comprising a developer surface cleaner which removes excess toner from the developer surface after it leaves the development region.

31. Apparatus according to claims 30, wherein the squeegee surface is formed with end portions which mate with the recessed end surfaces of the first surface.

32. Apparatus according to claim 31 wherein the first surface is the surface of a roller.

33. Apparatus according to claim 32 wherein the squeegee surface is the surface of a squeegee roller, wherein the squeegee surface moves together with the first surface at the squeegee region.

34. Apparatus according to claim 33 wherein the recessed end portions comprise beveled, cone shaped surfaces.

35. Apparatus according to claim 32 wherein the recessed end portions comprise beveled, cone shaped surfaces.

36. Apparatus according to claim 31 wherein the squeegee surface is the surface of a squeegee roller, wherein the squeegee surface moves together with the first surface at the squeegee region.

37. Apparatus according to claim 36 wherein the recessed end portions comprise beveled, cone shaped surfaces.

38. Apparatus according to claim 31 wherein the recessed end portions comprise beveled, cone shaped surfaces.

39. Apparatus according to claim 30 wherein the recessed end portions comprise beveled, cone shaped surfaces.

40. Apparatus according to claims 17, wherein the squeegee surface is formed with end portions which mate with the recessed end surfaces of the first surface.

41. Apparatus according to claim 40 wherein the first surface is the surface of a roller.

42. Apparatus according to claim 14 wherein the squeegee surface is the surface of a squeegee roller, wherein the squeegee surface moves together with the first surface at the squeegee region.

43. Apparatus according to claim 42 wherein the recessed end portions comprise beveled, cone shaped surfaces.

44. Apparatus according to claim 14 wherein the recessed end portions comprise beveled, cone shaped surfaces.

45. Apparatus according to claim 40 wherein the squeegee surface is the surface of a squeegee roller, wherein the squeegee surface moves together with the first surface at the squeegee region.

46. Apparatus according to claim 45 wherein the recessed end portions comprise beveled, cone shaped surfaces.

47. Apparatus according to claim 40 wherein the recessed end portions comprise beveled, cone shaped surfaces.

48. Apparatus according to claim 17 wherein the first surface is the surface of a roller.

49. Apparatus according to claim 48 wherein the squeegee surface is the surface of a squeegee roller, wherein the squeegee surface moves together with the first surface at the squeegee region.

50. Apparatus according to claim 49 wherein the recessed end portions comprise beveled, cone shaped surfaces.

51. Apparatus according to claim 48 wherein the recessed end portions comprise beveled, cone shaped surfaces.

52. Apparatus according to claim 17 wherein the squeegee surface is the surface of a squeegee roller, wherein the squeegee surface moves together with the first surface at the squeegee region.

53. Apparatus according to claim 52 wherein the recessed end portions comprise beveled, cone shaped surfaces.

54. Apparatus according to claim 17 wherein the recessed end portions comprise beveled, cone shaped surfaces.

55. Imaging apparatus including squeegee apparatus for squeegeeing excess liquid from liquid toner, comprising toner particles and carrier liquid, from a surface, from which surface at least a portion of the liquid toner remaining after squeegeeing is to be transferred to a surface other than the squeegee, comprising:

a first surface having a central portion and two end portions having recessed surfaces and having a liquid toner material, comprising toner particles and a liquid carrier thereon, at least in said central portion, said surface moving in a given direction at a squeegee region; and a second, squeegee, surface, urged against at least the central portion of the first surface at the squeegee region and operative to remove at least a portion of the liquid carrier from the liquid toner material, prior to transfer of at least a portion of the material remaining after said removal, to a third surface.

56. Imaging apparatus according to claim 55 wherein the second surface is formed with contiguous end portions which mate with the recessed end surfaces of the first surface.

57. Imaging apparatus according to claim 55 wherein the recessed end portions comprise beveled, cone shaped surfaces.

58. Imaging apparatus according to claim 56 wherein the recessed end portions comprise beveled, cone shaped surfaces.

* * * * *

UNITED STATES PATENT AND TRADEMARK OFFICE

CERTIFICATE OF CORRECTION

PATENT NO. : 5,854,960

DATED : December 29, 1998

INVENTOR(S) : B. TAGANSKY et al.

It is certified that error appears in the above-indentified patent and that said Letters Patent is hereby corrected as shown below:

On the cover of the printed patent, Continuing Data Information was omitted and should be included to read as follows:

—THIS APPLN IS A CONT OF PCT/NL95/00195 FILED JUNE 6, 1995—.

At column 7, line 40 (claim 42, line 1) of the printed patent, "14" should be ---41---.

At column 7, line 46 (claim 44, line 46) of the printed patent, "14" should be ---41---.

Signed and Sealed this

Sixth Day of June, 2000

*Attest:*

*Attesting Officer*

Q. TODD DICKINSON

*Director of Patents and Trademarks*